US007713177B2

(12) United States Patent
Lo

(10) Patent No.: US 7,713,177 B2
(45) Date of Patent: May 11, 2010

(54) BUFFERING APPARATUS

(76) Inventor: Chiu Hsiang Lo, No. 72, Chaoguei Rd., Situn District, Taichung City 407 (TW)

( * ) Notice: Subject to any disclaimer, the term of this patent is extended or adjusted under 35 U.S.C. 154(b) by 73 days.

(21) Appl. No.: 12/106,324

(22) Filed: Apr. 20, 2008

(65) Prior Publication Data

US 2009/0264258 A1 Oct. 22, 2009

(51) Int. Cl.
*A63B 22/02* (2006.01)

(52) U.S. Cl. ..... 482/54

(58) Field of Classification Search ..... 482/51–54; 119/770

See application file for complete search history.

(56) References Cited

U.S. PATENT DOCUMENTS 6,174,268 B1 * 1/2001 Novak ..... 482/54
6,280,362 B1 * 8/2001 Dalebout et al. ..... 482/54
2001/0016543 A1 * 8/2001 Dalebout ..... 482/54
2003/0139261 A1 * 7/2003 Kuo ..... 482/54
2003/0153434 A1 * 8/2003 Dalebout et al. ..... 482/54
2009/0088301 A1 * 4/2009 Alling ..... 482/54

* cited by examiner

*Primary Examiner*—Fenn C Mathew
(74) *Attorney, Agent, or Firm*—Banger Shia

(57) ABSTRACT

A treadmill includes an external frame, an internal frame connected to the external frame, a belt in the form of a loop supported on the internal frame and a buffering apparatus for buffering the internal frame. The buffering apparatus includes a crossbar and two buffer sets. The crossbar is rotationally provided on the external frame between various positions. Each of the buffer sets includes a plurality of buffering blocks made with different elastic coefficients so that a selected one of the buffering blocks is brought into contact with the internal frame when the crossbar is in a related one of the positions.

7 Claims, 6 Drawing Sheets

BUFFERING APPARATUS

BACKGROUND OF INVENTION

1. Field of Invention

The present invention relates to a treadmill and, more particularly, to a buffering apparatus for use in a treadmill.

2. Related Prior Art

Many people live a busy and stressed life. Exercise of an adequate quantity and an appropriate intensity is good for the physical and mental health of these people and even for their efficiencies while working.

Treadmills are popular in gyms and homes because they are easily operable and help people of almost all ages enjoy exercise. As treadmills are getting popular, people are paying more attention to their safety on treadmills. That is, people are paying more attention to the strength and reliability of treadmills. To this end, people tend to make bigger treadmills. However, bigger treadmills are heavier and occupy more space. Moreover, bigger treadmills cost more since materials are more and more expensive.

The present invention is therefore intended to obviate or at least alleviate the problems encountered in prior art.

SUMMARY OF INVENTION

It is the primary objective of the present invention to provide a buffering apparatus for a treadmill with excellent buffering effects.

According to the present invention, a treadmill includes an external frame, an internal frame connected to the external frame, a belt in the form of a loop supported on the internal frame and a buffering apparatus for buffering the internal frame. The buffering apparatus includes a crossbar and two buffer sets. The crossbar is rotationally provided on the external frame between various positions. Each of the buffer sets includes a plurality of buffering blocks made with different elastic coefficients so that a selected one of the buffering blocks is brought into contact with the internal frame when the crossbar is in a related one of the positions.

Other objectives, advantages and features of the present invention will become apparent from the following description referring to the attached drawings.

BRIEF DESCRIPTION OF DRAWINGS

The present invention will be described via the detailed illustration of the preferred embodiment referring to the drawings.

DETAILED DESCRIPTION OF PREFERRED EMBODIMENT

Figure 1:
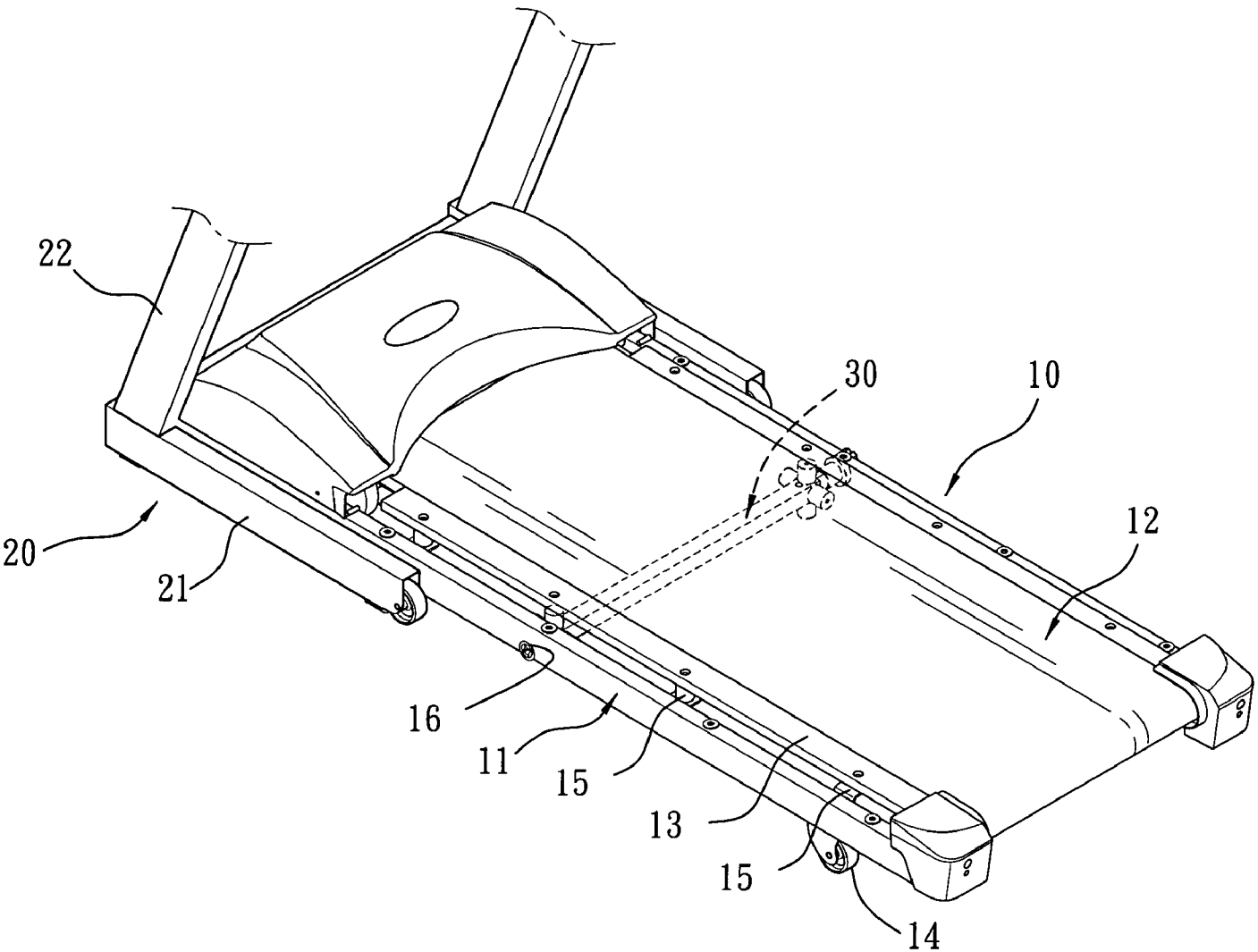
FIG. 1 is a perspective view of a treadmill equipped with a buffering apparatus according to the preferred embodiment of the present invention.

Referring to FIG. 1, a treadmill includes a platform 10, a belt 12, a handle unit 20 and a buffering apparatus 30 according to the preferred embodiment of the present invention. The platform 10 includes an external frame 11, an internal frame 13 and joints 15 for connecting the external frame 11 to the internal frame 13. Two apertures 16 are defined in a middle portion of the external frame 11.

The belt 12 is in the form of a loop movably provided around the internal frame 13. The belt 12 slides on the internal frame 13 when a person runs on the belt 12.

Casters 14 are attached to the external frame 11 so that the treadmill is movable.

The handle unit 20 includes two lower bars 21 and two upper bars 22 connected to the lower bars 21. Although not shown, a handlebar is provided between the upper bars 22, and an instrument is often provided on the handle bar.

Figure 2:
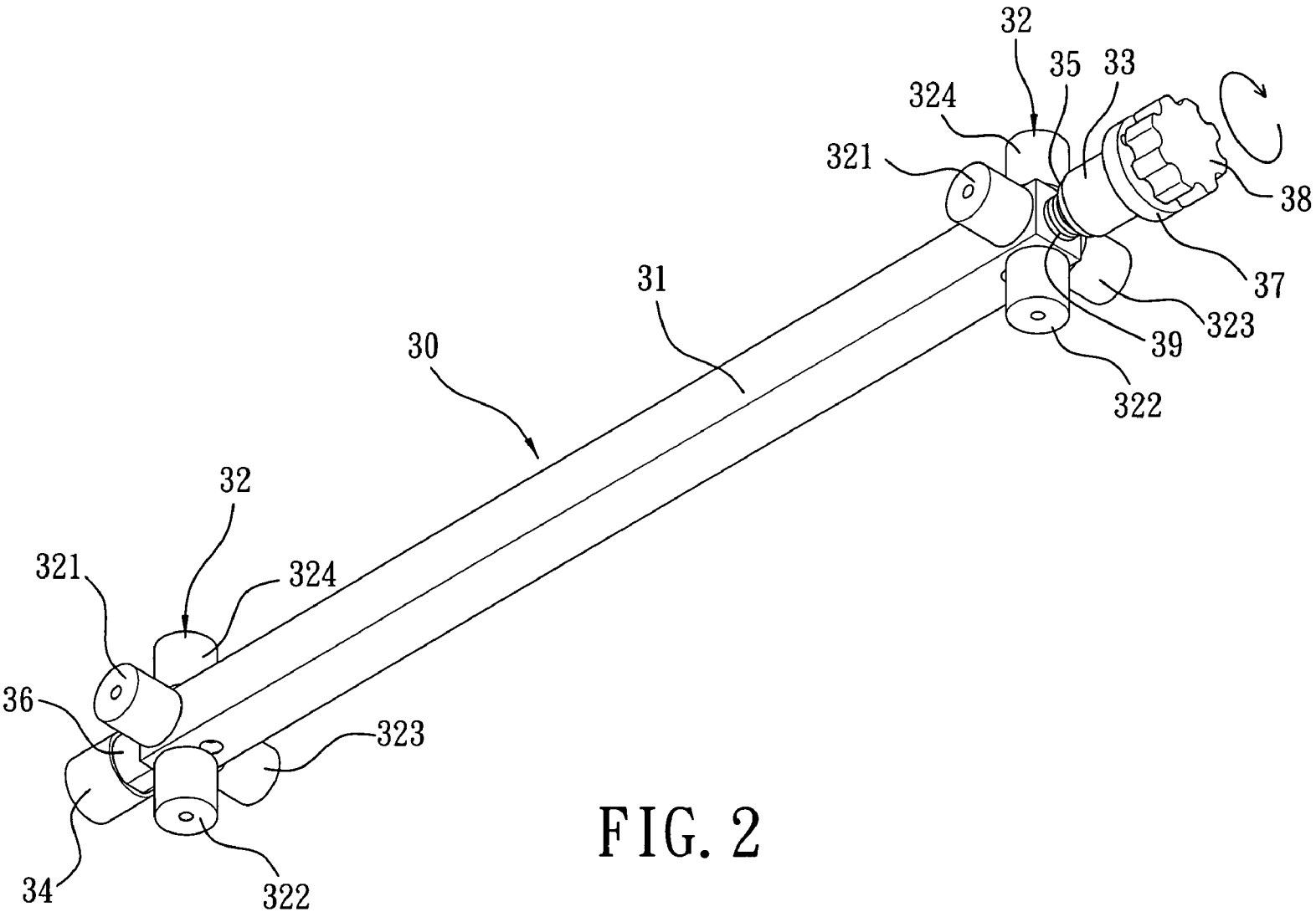
FIG. 2 is a perspective view of the buffering apparatus of FIG. 1.
Figure 5:
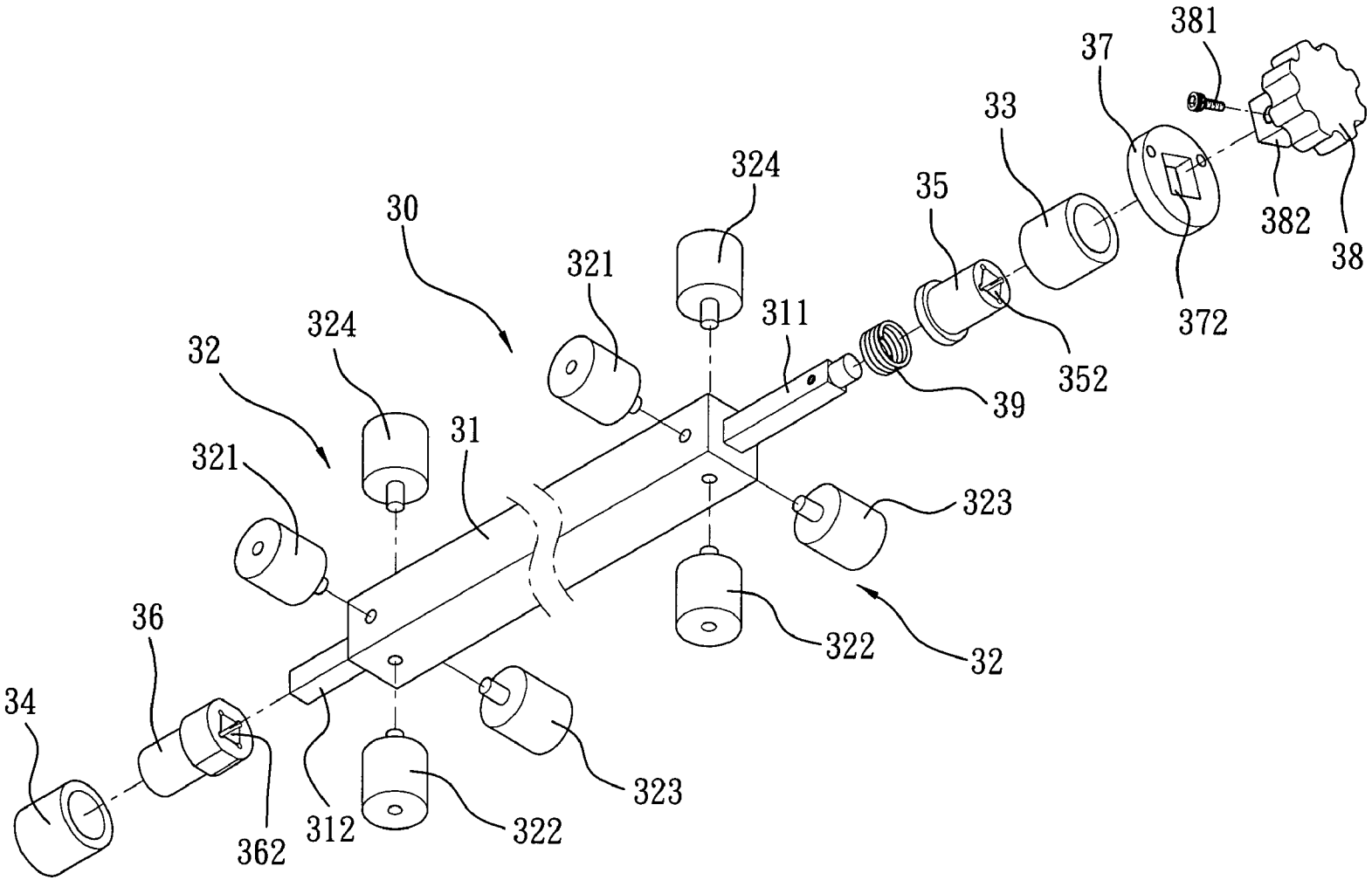
FIG. 5 is an exploded view of the buffering apparatus shown in FIG. 2.

Referring to FIGS. 2 and 5, the buffering apparatus 30 includes a crossbar 31, two buffer sets 32 provided near two ends of the crossbar 31, a helical spring 39, two sleeves 35 and 36, two bushings 33 and 34, a ring 37 and a knob 38. The crossbar 31 includes two reduced ends 311 and 312 which are square in a cross-sectional view.

Each of the buffer sets 32 includes four buffering blocks 321, 322, 323 and 324 secured to the crossbar 31. The buffering blocks 321, 322, 323 and 324 are made of different elastic coefficients. In a first position of the crossbar 31 on the external frame 11, the buffering blocks 321 are in contact with the internal frame 13. In a second position, the buffering blocks 322 are in contact with the internal frame 13. In a third position, the buffering blocks 323 are in contact with the internal frame 13. In a fourth position, the buffering blocks 324 are in contact with the internal frame 13.

The sleeve 36 includes an aperture 362. The reduced end 312 of the crossbar 31 is inserted in the aperture 362 so that the former cannot rotate but slide within the latter.

The bushing 34 is fit in one of the apertures 16. The sleeve 36 is rotationally inserted in the bushing 34.

The helical spring 39 is provided around the reduced end 311 of the crossbar 31.

The sleeve 35 includes an aperture 352. The reduced end 311 of the crossbar 31 is inserted in the aperture 352 so that the former cannot rotate but slide in the latter. The helical spring 39 is compressed between the crossbar 31 and the sleeve 35.

The bushing 33 is fit in the other aperture 16. The sleeve 35 is rotationally inserted in the bushing 33.

The ring 37 is secured to the external frame 11. That is, the ring 37 cannot be rotated on the external frame 11. The ring 37 includes an aperture 372 that is non-circular and preferably square. The reduced end 311 of the crossbar 31 can be rotated in the aperture 372 of the ring 37.

The knob 38 includes a block 382 secured to the square reduced end 311 of the crossbar 31 with a threaded bolt 381. The block 382 is non-circular and preferably square. The block 382 cannot be rotated in the aperture 372.

Figure 3:
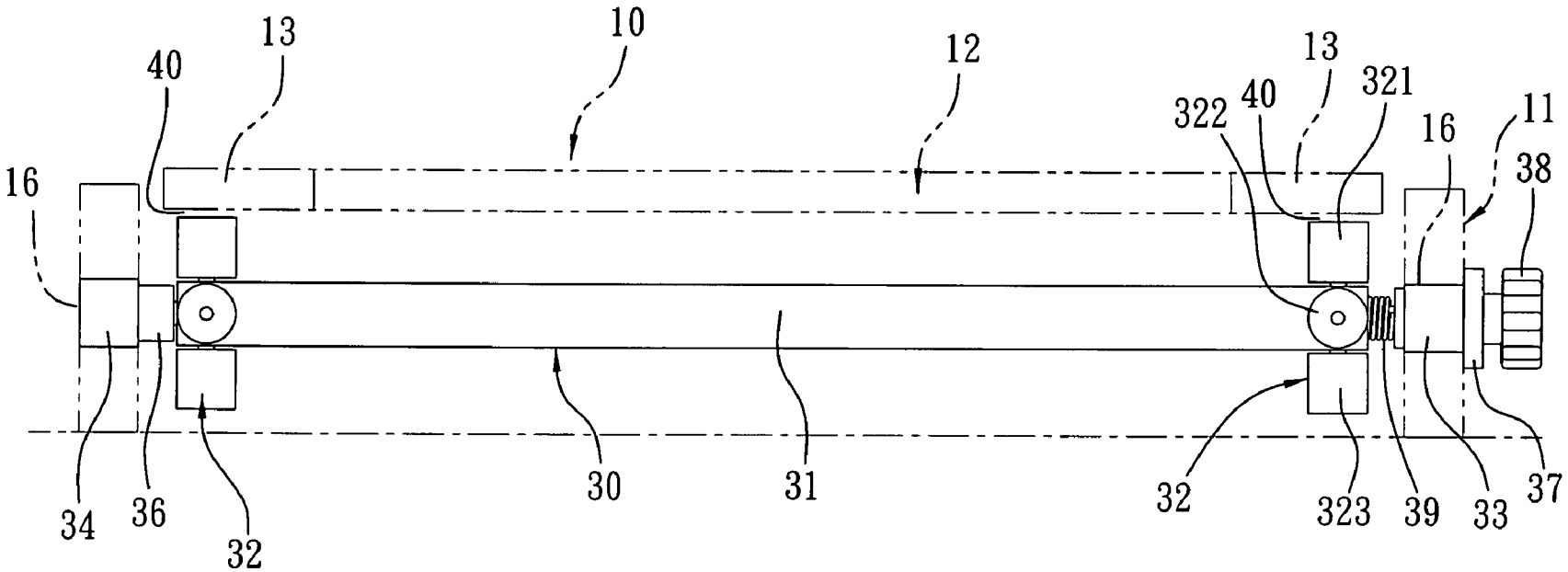
FIG. 3 is a rear view of the buffering apparatus shown in FIG. 2.
Figure 4:
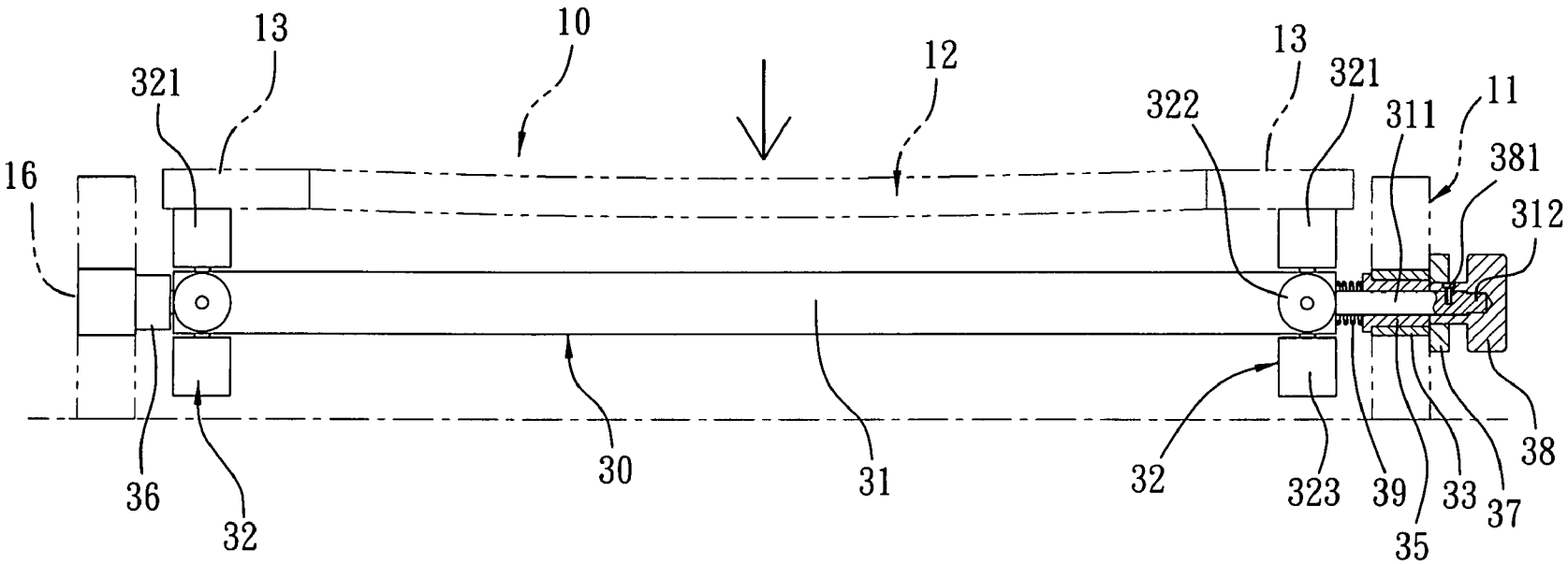
FIG. 4 is a rear view of the buffering apparatus in another position than shown in FIG. 3.

Referring to FIGS. 3 and 4, due to the helical spring 39 compressed between the external frame 11 and the sleeve 35, the block 382 is retained in the aperture 372 so that the knob 38 cannot be rotated relative to the ring 37. Accordingly, the crossbar 31 is retained in the first position for example. Hence, the buffering blocks 321 contact the belts 12.

Figure 6:
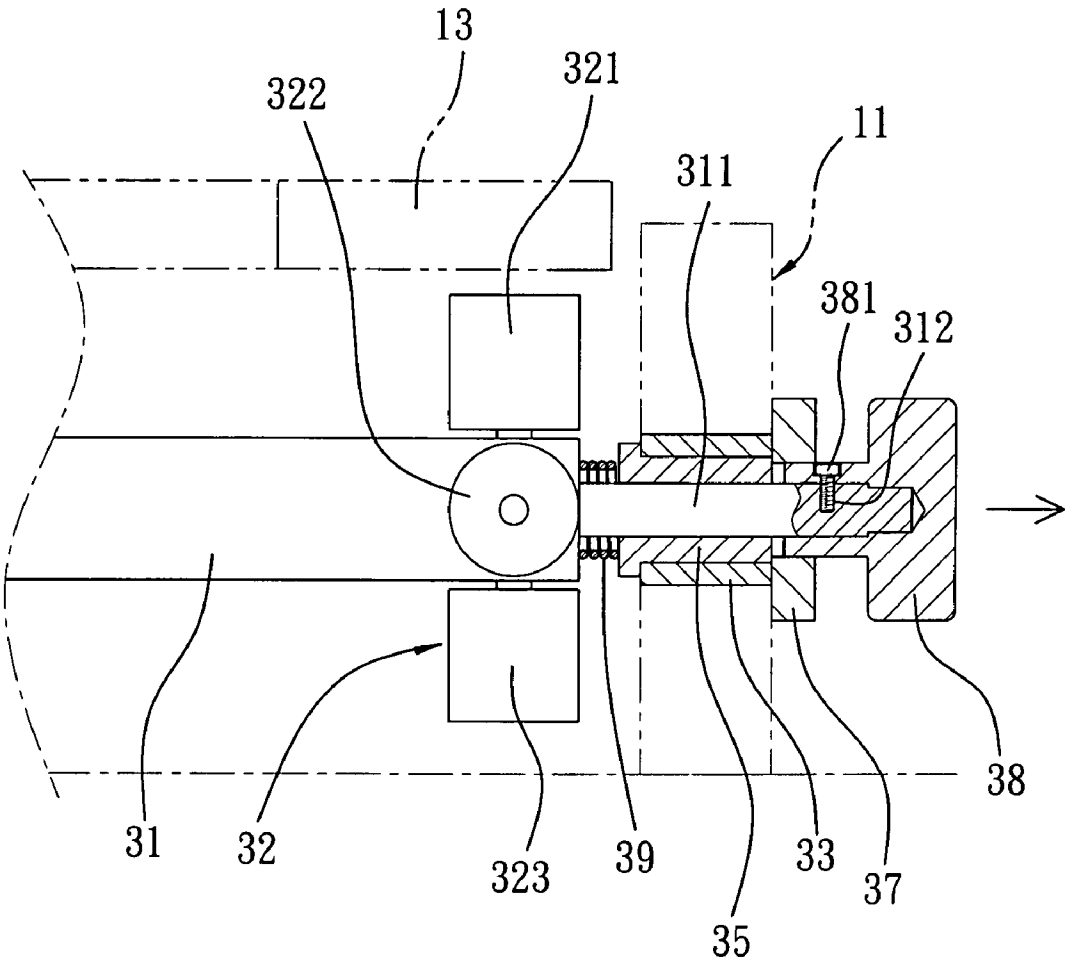
FIG. 6 is an enlarged partial view of the buffering apparatus shown in FIG. 4.

Referring to FIG. 6, the knob 38 is pulled so that the block 382 is moved out of the aperture 372 while the reduced end 311 is inserted in the aperture 372. As mentioned, the reduced end 311 can be rotated in the aperture 372. Accordingly, the crossbar 31 can be rotated to another position from the first position so that the internal frame 13 contacts other buffering blocks than the buffering blocks 321.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A treadmill comprising:

an external frame;

an internal frame connected to the external frame;

a belt in the form of a loop supported on the internal frame; and a buffering apparatus comprising:

a crossbar rotationally provided on the external frame between various angular positions;

a knob connected to the crossbar so that the crossbar can be rotated by turning the knob;

a non-circular block formed on the knob;

a ring secured to the external frame and made with a non-circular aperture defined therein, wherein the knob is movable between a first position where the non-circular block is disposed in the non-circular aperture non-rotationally to avoid the rotation of the crossbar and a second position where the non-circular block is out of the non-circular aperture to allow the rotation of the crossbar; and two buffer sets each comprising a plurality of buffering blocks made with different elastic coefficients so that a selected one of the buffering blocks is brought into contact with the internal frame when the crossbar is in a related one of the angular positions.

2. The treadmill according to claim 1, wherein the buffering apparatus comprises an elastic element compressed between the crossbar and the external frame, thus retaining the knob in the first position.

3. The treadmill according to claim 1, wherein the crossbar comprises a reduced end connected to the non-circular block and inserted in the non-circular aperture rotationally when the knob is in the second position.

4. The treadmill according to claim 3, wherein the buffering apparatus comprises a bushing provided on the external frame for supporting the reduced end of the crossbar.

5. The treadmill according to claim 4, wherein the buffering apparatus comprises a sleeve provided around the reduced end of the crossbar so that there is no relative rotation between them, and the sleeve is rotationally inserted in the bushing.

6. The treadmill according to claim 5, wherein the reduced end of the crossbar is non-circular, and the sleeve comprises a non-circular aperture for receiving the reduced end of the crossbar.

7. The treadmill according to claim 6, wherein the elastic element is compressed between the sleeve and the crossbar.

* * * * *